US006103017A

United States Patent [19]

Thies et al.

[11] Patent Number: 6,103,017

[45] **Date of Patent: *Aug. 15, 2000**

[54] AUTOMATIC PURGE FILTRATION FOR A DISHWASHER

[75] Inventors: Edward L. Thies, Niles; Roger J. Bertsch, Stevensville; Wilbur W. Jarvis, St. Joseph, all of Mich.

[73] Assignee: Whirlpool Corporation, Benton Harbor, Mich.

[ * ] Notice: Under 35 U.S.C. 154(b), the term of this patent shall be extended for 149 days.

[21] Appl. No.: 09/273,244

[22] Filed: Mar. 19, 1999

Related U.S. Application Data

[63] Continuation of application No. 08/927,706, Sep. 10, 1997, Pat. No. 5,909,743

[60] Provisional application No. 60/031,182, Nov. 19, 1996.

[51] Int. Cl.[7] ..... A47L 15/46

[52] U.S. Cl. ..... 134/10; 134/18; 134/25.2; 134/56 D; 134/104.1; 134/104.4; 134/111; 134/186

[58] Field of Search ..... 134/10, 18, 25.2, 134/56 D, 57 D, 58 D, 104.1, 104.4, 111, 115 G, 186, 188, 191, 195; 241/46.021

[56] References Cited

U.S. PATENT DOCUMENTS

| | | | |
|---|---|---|---|
| 2,024,952 | 12/1935 | Snyder et al. . | |
| 2,729,219 | 1/1956 | Smith, Jr. . | |
| 3,034,519 | 5/1962 | Jacobs . | |
| 3,457,929 | 7/1969 | Madden . | |
| 3,807,418 | 4/1974 | Jenkins . | |
| 3,810,480 | 5/1974 | Smith et al. . | |
| 4,038,103 | 7/1977 | Grunewald . | |
| 4,168,715 | 9/1979 | Spiegal et al. . | |
| 4,201,345 | 5/1980 | Ziegler . | |
| 4,279,384 | 7/1981 | Yamamoto | 134/58 D X |
| 4,319,599 | 3/1982 | Dingler et al. | 134/104.4 |
| 4,350,306 | 9/1982 | Dingler et al. . | |
| 4,392,891 | 7/1983 | Meyers | 134/10 |
| 5,429,679 | 7/1995 | Young, Jr. | 134/25.2 |
| 5,601,660 | 2/1997 | Jeon et al. | 134/104.1 X |
| 5,762,080 | 6/1998 | Edwards et al. | 134/58 D |
| 5,779,812 | 12/1998 | Thies et al. | 134/111 X |

FOREIGN PATENT DOCUMENTS

| | | | |
|---|---|---|---|
| 2657764 | 6/1978 | Germany | 134/111 |
| 2737440 | 2/1979 | Germany | 134/104.1 |
| 2745645 | 4/1979 | Germany . | |
| 6-54789 | 6/1978 | Japan . | |

*Primary Examiner*—Philip R. Coe

*Attorney, Agent, or Firm*—Thomas J. Roth; Joel M. Van Winkle; Robert O. Rice

[57] ABSTRACT

A dishwasher pump and automatic purge system for a dishwasher having a recirculation pump, a drain pump and a wash chamber having a sump. The recirculation pump includes a main outlet and a secondary outlet wherein wash liquid pumped out through the main outlet is recirculated throughout the dishwasher interior wash chamber during a wash phase. The sump includes a soil collector which receives wash liquid from the secondary outlet. The soil collector includes a filter screen for returning filtered wash liquid back into the sump such that soils are retained in the soil collector. During a first wash phase while the recirculation pump is recirculating wash liquid throughout the wash chamber, the drain pump is energized on and off to drain soils from the soil collector. More specifically, the drain pump is energized on and off during the wash phase in response to the pressure within the soil collector which is sensed by a pressure sensor.

21 Claims, 7 Drawing Sheets

AUTOMATIC PURGE FILTRATION FOR A DISHWASHER

This is a continuation of Application No. 08/927,706, entitled "AUTOMATIC PURGE FILTRATION SYSTEM FOR A DISHWASHER", filed on Sep. 10, 1997 is now 5,909,743, which claimed the benefit of U.S. Provisional Application No. S/N 60/031,182 filed on Nov. 19, 1996.

BACKGROUND OF THE INVENTION

The present invention relates to a dishwasher filtration and soil collection system, and more particularly to a system for automatically purging a filter and soil collection system in a dishwasher to remove accumulated soils.

Typical domestic dishwashers in use today draw wash liquid from a sump at the bottom of a wash tub and spray the wash liquid within the wash tub to remove soils from dishes located on racks in the tub. In an attempt to improve performance and efficiency, some dishwashers employ a system for separating soil out of the recirculating wash liquid and for retaining the soils in a collection chamber. Frequently, a filter screen is used to retain soil in a soil collection chamber. U.S. Pat. No. 5,165,433, for example, discloses a dishwasher system including a centrifugal soil separator which sends soil laden wash liquid into a soil container whereupon the soil laden wash liquid passes through a fine filter disposed in the wall of the soil container.

Inherent in the system described in the '433 patent, and in any fine mesh filter screen system in a dishwasher, is the problem of screen clogging by food soils removed from the dishes. Typically, backwash jets are directed against the filter in an attempt to clear the filter and prevent clogging. Heavy soil loads, however, can result in screen clogging in spite of backwash jets.

Screen clogging can adversely affect the dishwasher's cleaning ability, causing poor washability and indirectly causing increased water and energy consumption. Moreover, the build-up of pressure behind the screen may increase—to a maximum determined by the ability of the pump supplying soil laden wash liquid against the screen—and result in soil embedding into the screen such that it is difficult to subsequently remove the soils from the screen.

Some attempts have been made to develop a dishwasher wash system which is capable of dealing with heavy soil loads and avoid filter clogging. U.S. Pat. No. 4,559,959 discloses a dishwasher wherein soil load is measured by monitoring pressure in a soil collection chamber in which soils are retained after the wash liquid passes through a filter mesh. If the pressure exceeds a predetermined limit, indicating that the filter mesh is clogged, the wash liquid is completely purged by draining all of the wash liquid out of the tub and refilling the tub with fresh water. The '959 patent provides for a maximum of three complete purges at the beginning of the dishwasher cycle. Additionally, the number of purges required is monitored and that information is used to control the subsequent wash cycle—selecting the appropriate cycle for the soil load of the dishes.

Concerns over dishwasher water and energy consumption make complete purges of wash liquid from a tub undesirable. Accordingly, some dishwasher systems utilize purges which only partially drain the dishwasher tub. For example, U.S. Pat. No. 4,346,723 discloses a dishwashing system wherein soils are collected in a bypass soil collector. The soil collector may be purged by draining small amounts of wash liquid in "spurts" during an early wash period by selectively opening and closing a drain valve.

U.S. Pat. No. 5,223,042 discloses a method of washing dishes wherein during the wash cycle a portion of the washing solution is drained from the bottom of the tub to remove soils. The wash solution is subsequently replenished with fresh water having a volume equal to the volume of the discharged wash solution.

U.S. Pat. No. 5,429,679 includes a soil collection system wherein wash liquid is sent into a filtration chamber and then returned to the tub sump through a filter. After the first wash cycle, a portion of wash liquid, approximately 1 gallon out of the total 2.3 gallons of wash liquid, is sent to drain and then replaced by adding fresh water to the tub.

The above described systems all include several drawbacks. One of the most significant is that, for all of these references, a relatively large quantity of water is drained during each purge. Moreover, several of the above references teach interrupting the wash operation during each drain purge such that no spray is directed against the dishes while wash liquid is being purged. Another problem with the above described systems is one of soil redeposition wherein soils, collected in the soil collection chamber prior to each purge, are redeposited onto the dishes during the purge cycle.

SUMMARY OF THE INVENTION

In accordance with the present invention, a dishwasher is provided having a dishwasher pump and soil collection system which includes a recirculation pump having a wash impeller supported for rotation within a pump chamber wherein the pump chamber has a main outlet and a secondary outlet. The wash impeller draws wash liquid from the dishwasher sump region and pumps the wash liquid through the main outlet such that wash liquid is recirculated throughout the dishwasher interior wash chamber. A soil collector is provided including a soil separation channel for receiving wash liquid from the pump chamber through the secondary outlet wherein the soil separation channel includes a filter screen for returning filtered wash liquid back into the sump such that soils are retained in the soil separation channel and accumulate within a soil accumulator.

During a wash phase, while the recirculation pump is recirculating wash liquid through the wash chamber, the pressure within the soil accumulator is sensed by a pressure sensor. When the pressure within the soil accumulator exceeds a predetermined limit level, a drain pump, having an inlet fluidly connected to the accumulator, is energized such that soils are cleared from the accumulator and the filter screen. When the pressure within the soil accumulator is reduced to below the predetermined limit level, the drain pump is deenergized. In this manner, the drain pump is turned on and off while the wash pump is energized during the wash phase. Following the wash phase, the drain pump is energized to drain wash liquid from the wash chamber.

DETAILED DESCRIPTION OF THE PREFERRED EMBODIMENTS

Figure 1:
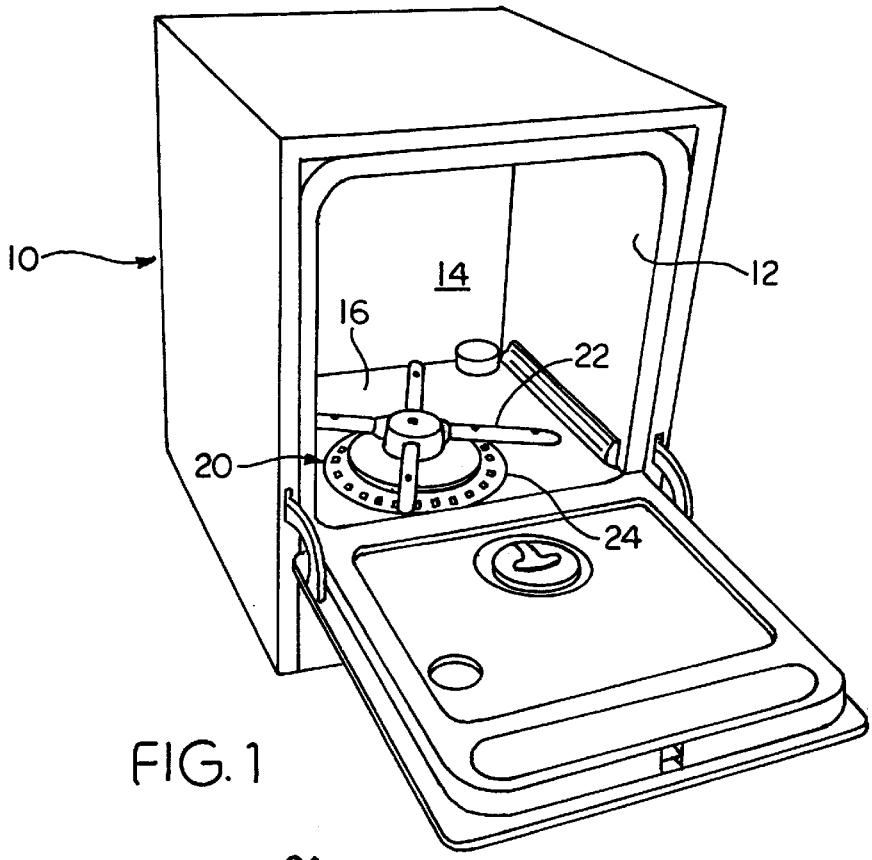
FIG. 1 is a perspective view of a dishwasher including a soil separation and collection system in accordance with the present invention.

In accordance with the invention as shown in the drawings, and particularly as shown in FIG. 1, an automatic dishwasher generally designated 10 includes an interior tub 12 forming an interior wash chamber or dishwashing space 14. The tub 12 includes a sloped bottom wall 16 which defines a lower tub region or sump 18 (FIG. 4) of the tub. A soil separator and pump assembly 20 is centrally located in the bottom wall 16 and has a lower wash arm assembly 22 extending from an upper portion thereof. A coarse particle grate 24 permits wash liquid to flow from the bottom wall 16 to soil separator 20 while preventing large foreign objects from entering the pump system.

The basic constructional features of the soil separator are explained in patent application Ser. No. 08/694,216, entitled "Soil Separation Channel for a Dishwasher Pump System", herein incorporated by reference. In that application, the operation of a centrifugal soil separator and the construction of a soil separator and collector are filly explained.

Figure 3:
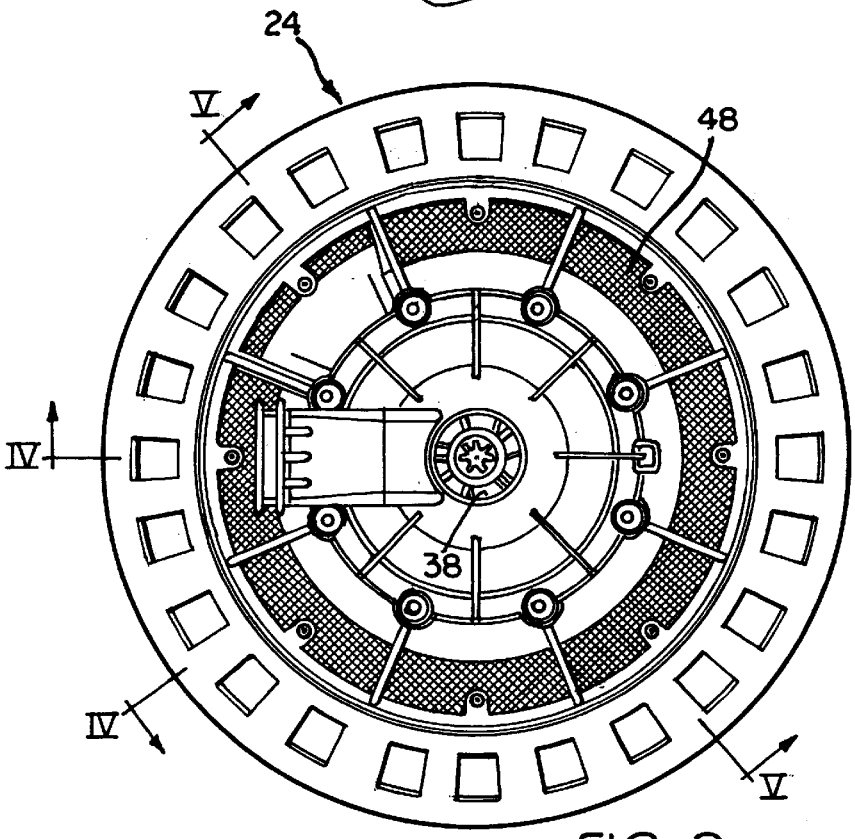
FIG. 3 is a top view of the pump system of the dishwasher shown in FIG. 1.
Figure 2:
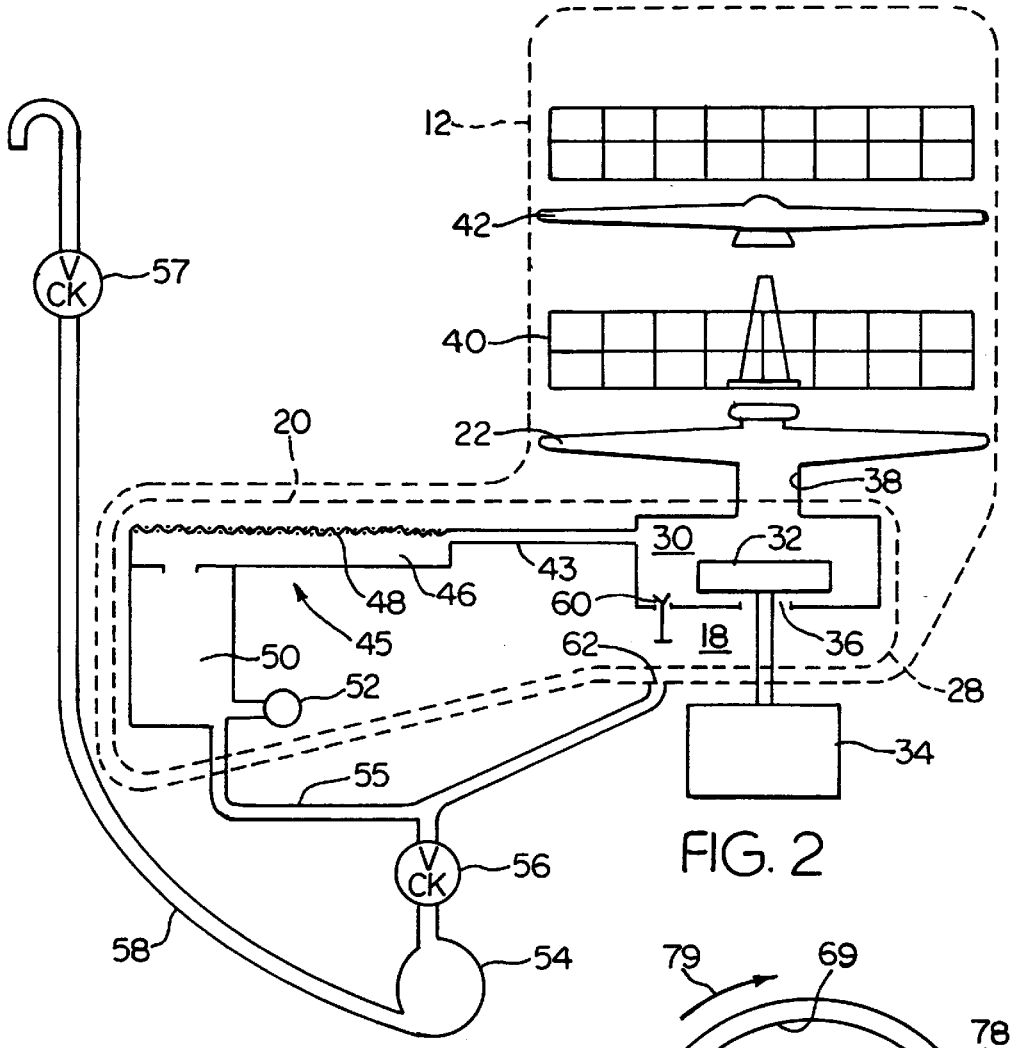
FIG. 2 is a schematic illustration of the soil separation and collection system of the present invention and embodied in the dishwasher shown in FIG. 1.
Figure 4:
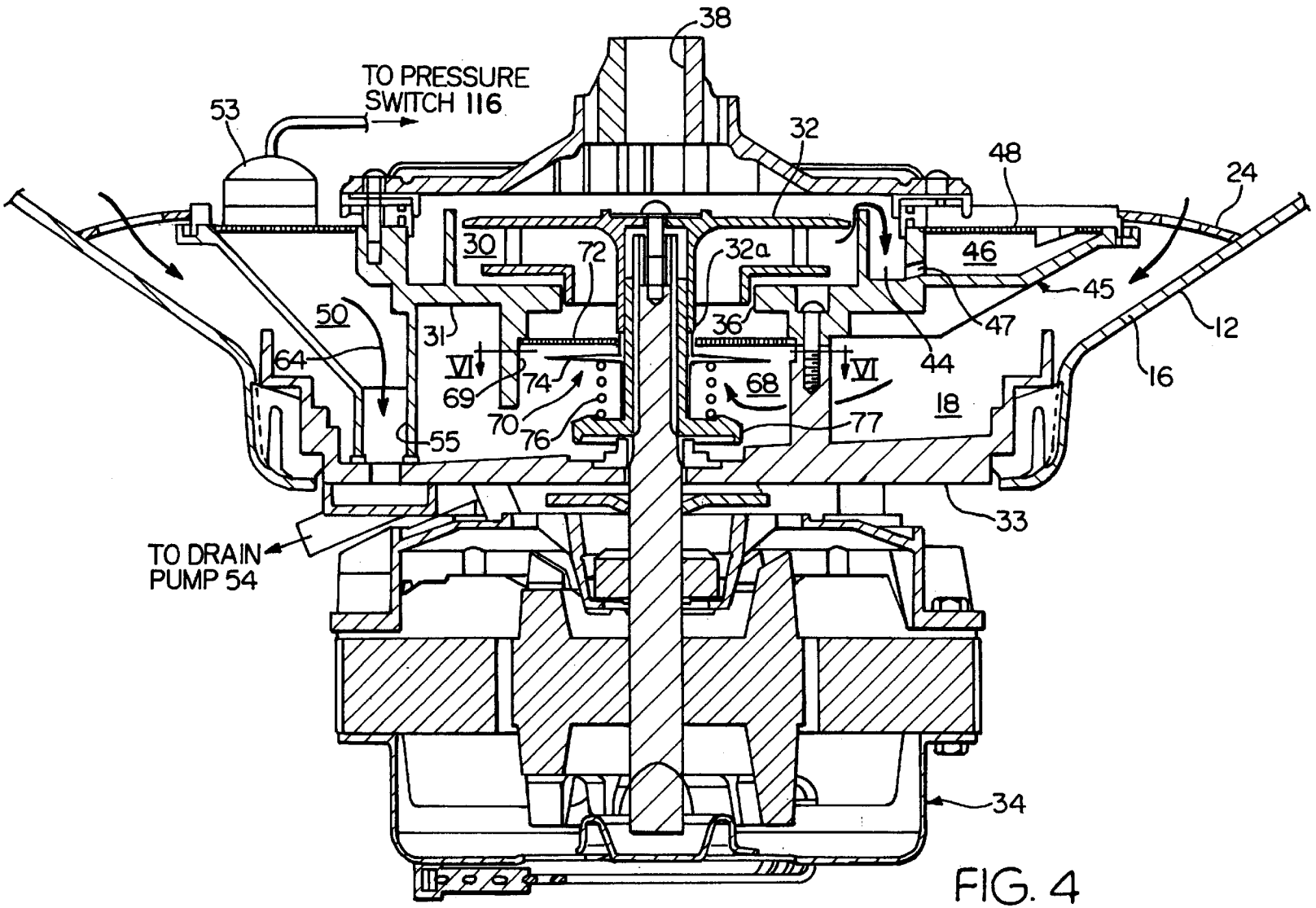
FIG. 4 is a diametric sectional view taken along line IV—IV of FIG. 3, illustrating fluid flow during soil accumulator purging.

Turning to FIGS. 2, 3 and 4, it can be seen that the soil separator/pump assembly 20 includes a wash pump 28 having a wash impeller 32 disposed within a pump chamber 30 defined by a pump housing 31. The pump housing 31 is supported by a pump base 33. During a wash cycle, the wash impeller 32, driven by motor 34, draws wash liquid from the sump 18 through a pump inlet 36, provided between the pump housing 31 and pump base 33, and pumps wash liquid up through a main pump outlet 38 into the lower spray arm 22. A first portion of wash liquid is sprayed from the lower spray arm 22 against dishes supported on a lower dishrack 40 and a second portion of wash liquid is directed toward an upper spray arm 42. Wash liquid is repeatedly recirculated over the dishes for removing soils therefrom.

Once soils are removed from the dishes, they are washed down into the sump 18, drawn into the pump inlet 36 whereupon the soils encounter a chopping region 68 defined by annular wall 69 surrounding a chopper assembly 70 for chopping and reducing the size of soil particles which enter the pump chamber 30. Many of the basic constructional features of the chopper assembly are explained in U.S. Pat. No. 4,319,599, entitled "Vertical Soil Separator for Dishwasher", herein incorporated by reference. The chopper assembly 70 includes a sizing screen 72 and a chopper 74 which is urged against a downwardly facing shoulder 32*a* of the wash impeller 32 by a coil spring 76. The upper distal end of the coil spring 76 extends radially outwardly into a groove provided in the chopper 74 and a lower distal end of the coil spring 76 extends into and is driven in rotation by a blind hole provided in drive hub 77.

Figure 6:
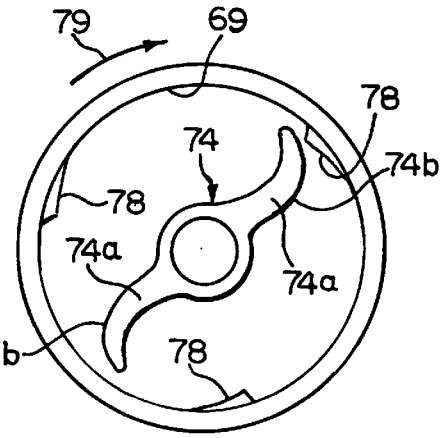
FIG. 6 is a transverse sectional view taken substantially along line VI—VI of FIG. 4.

As shown in FIG. 6, the chopper 74 includes a pair of outwardly extending, curved chopping blades 74*a* which are provided with sharp cutting edges 74*b* for comminuting soil particles that are trapped on the sizing screen 72 so that they may be reduced in size and subsequently pass through the sizing screen openings. The chopper 74 is driven in the rotational direction illustrated by arrow 79 such that soils which contact the cutting edges 74*b* and wrap about the chopping blades 74*a* are driven by the force of the water acting against the rotating chopper 74 to slide off the blade ends. Food soils swirling within the chopping region beyond the outer edges of the chopping blades 74*a* are driven back into the path of the blades 74*a* by deflector ribs 78 inwardly extending from the annular wall 69.

Referring now back to FIGS. 2 and 4, it can be understood that after being chopped and sized by the chopper assembly 70, the soils are drawn, along with the wash liquid, into the pump chamber 30. Within the pump chamber 30, under the action of the rotating wash impeller 32, the soils are centifugally separated and a sample of wash liquid having a high concentration of entrained soils is directed to flow from the pump chamber 30 through a sample outlet 43 into a soil collector 45 comprising an annular soil separation channel 46 and a soil accumulator 50. The sample outlet 43 is illustrated as an annular guide chamber 44 having a bottom opening 47 through which soils flow into the soil separation channel 46. Accordingly, the soil laden wash liquid is directed to flow into the soil separation channel 46 which has top wall formed from a filter screen 48. As the soil laden wash liquid proceeds within the separation channel 46 in an annular path, water passes upwardly through the filter screen 48 and back into the sump 18 leaving the soils within the separation channel 46. Within the soil separation channel 46, the velocity of the remaining wash liquid slows and the soils settle into the soil accumulator 50.

During the wash cycle, the filter screen 48 is repeatedly backflushed. As the lower wash arm 22 rotates, pressurized wash liquid is emitted from downwardly directed backflush nozzles. Means may be provided for forming a fan-shaped spray from the flow of wash liquid through the backflush nozzles. As the lower wash arm rotates, this fan shaped spray sweeps across the filter screen 48 providing a backwashing action to keep the screen clear of soil particles which may impede the flow of cleansed wash liquid into the sump 18.

As described above, in spite of backflushing, in conditions of a heavy soil load, the filter screen 48 may become clogged with food soils. When this occurs, wash performance is impaired and pressure within the soil accumulator 50 increases. This pressure increase is sensed by a pressure sensor 52 associated with a pressure tap tube connected to a pressure dome 53 provided above the soil accumulator 50 such that the pressure sensor 52 measures pressure within the soil accumulator 50. The pressure sensor 52 can be either an analog device or a digital device. When the pressure in the soil accumulator exceeds a predetermined limit pressure, indicative of a clogged screen mesh 48, a drain pump 54 is energized to clear the screen mesh. The drain pump 54 draws wash liquid, highly concentrated with soils, from the soil accumulator 50 through drain conduit 55 and pumps it past a check valve 56 through drain hose 58 to drain. When the pressure in the accumulator is lowered below the predetermined limit pressure the drain pump is deenergized. The duration of time during which the drain pump 54 is energized to clear the accumulator 50 and the screen mesh 48 is referred to as purging or a purge period.

In this manner, the soil separation and collection system of the present invention is purged of soils. It can be understood, moreover, that since the drain pump 54 is separate from the wash pump 28, the purging of soils from the soil accumulator 50 and soil separation channel 46 can be accomplished while the wash pump impeller 32 continues to recirculate wash liquid through the dishwashing space 14.

It should be noted that for this type of plumbing configuration it is necessary to maintain a minimum drain head pressure that is greater than the trip pressure of the pressure switch. Otherwise, it is possible that the pressure build-up in the accumulator, associated with the clogging of the filter, will be great enough to force the accumulator contents past the drain pump if the head pressure is less than the trip pressure, resulting in all the water being eventually depleted from the dishwasher. Also, the water could be siphoned from the dishwasher the first time the drain pump is turned on. One solution would be to establish a loop in the drain tube 58 sufficient to provide the necessary pressure head and add a check valve 57 to the top of the drain tube 58 and have the check valve 57 open to the inside of the dishwasher to permit aqualization of the air in the drain tube with the air in the tub.

As an alternative to the above described drain pump system, the present invention may utilize a drain pump driven by the wash pump motor in a manner similar to the drain pump described in U.S. Pat. No. 4,319,599, incorporated by reference above. In such a system, the pressure sensor 52 may be operated to control a drain valve associated with a drain line downstream of the drain pump such that when the filter screen 48 becomes clogged, the drain valve is opened to allow the drain pump to clear the accumulator. This type of system may have some undesirable leakage from the pump chamber into the drain pump area but would still provide beneficial results.

Figure 5A:
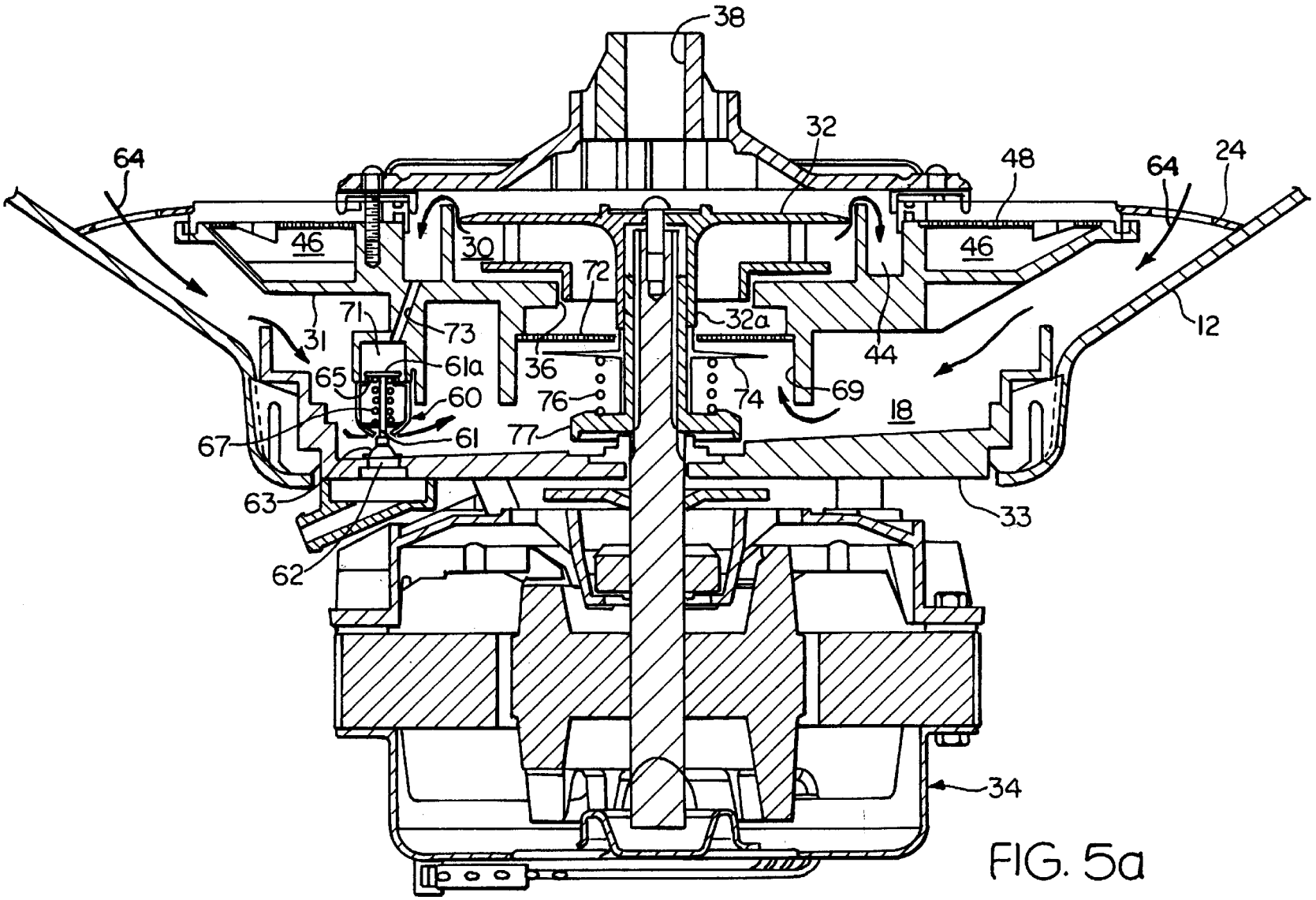
FIG. 5*a* is a diametric sectional view taken along line V—V of FIG. 3, showing the control valve in a closed position.
Figure 5B:
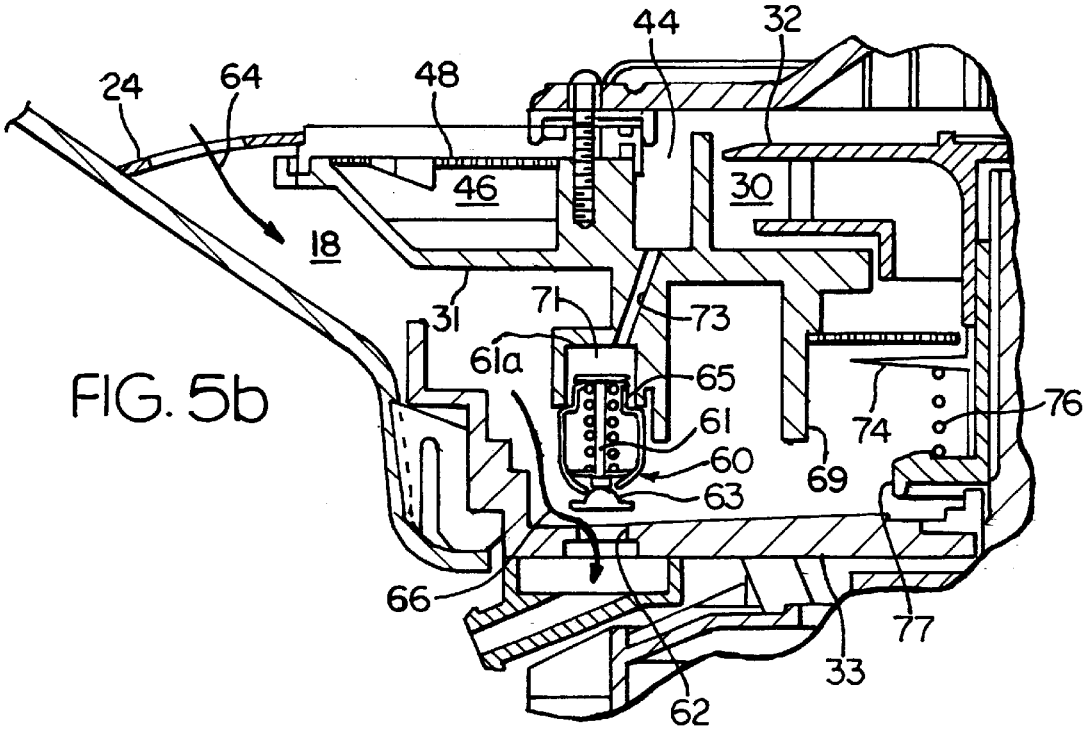
FIG. 5*b* is a partial sectional view illustrating the control valve in an open position, again taken along line V—V of FIG. 3.

Turning now to FIGS. 5*a* and 5*b*, it can be understood that in addition to drawing wash liquid from the soil accumulator 50, the drain pump 54 can drain the sump region 18 by drawing wash liquid through a drain port 62. However, to purge the accumulator 50 as quickly and effectively as possible, it is necessary to hydraulically isolate the accumulator 50 from the rest of the dishwasher when the drain pump is purging. Accordingly, during the wash cycle, when the wash impeller 32 is recirculating wash liquid throughout the interior wash chamber 14, the drain port 62 is closed by a pressure operated control valve system 60 such that the sump 18 is separated from the drain pump when the wash pump 28 is operating.

The control valve system 60 may be any type of system responsive to pressure generated by the operation of the wash pump 28 but is illustrated as a movable valve stem 61 supporting a plug seal 63. The valve stem 61 is supported along the underside of the pump housing 31. The valve stem 61 includes an upper pressure surface 61*a* secured to a flexible diaphram 65. A coil spring 67 is compressed between a spring retainer 69 and the backside of the upper pressure surface 61*a* such that the upper pressure surface 61*a* is urged upwardly into a cavity 71. The pressure cavity 71 is fluidly connected to the annular guide channel 44 via a conduit 73 such that the control valve 60 is responsive to the the pressure generated by the wash impellor 32.

Accordingly, when the wash impeller 32 is recirculating wash liquid within the pump chamber 30, the valve stem 61 is forced downwardly, as shown in FIG. 5*a*, responsive to the pressure in cavity 71 such that the plug seal 63 operates to seal the drain port 62. When the wash impellor 32 is not being rotated or when there is insufficient wash liquid to pressurized the cavity 71, the valve stem 61 is biased upwardly such that plug seal 63 is raised above the drain port 62, as shown in FIG. 5*b*, to open the drain port 62 when the wash pump 28 is not in operation.

As can be clearly seen in FIG. 5 and 5*a*, when the control valve 60 is closed, the drain pump 54 only draws wash liquid from the accumulator 50 when it is energized to purge soils, as illustrated by flow lines 64. It can be understood, therefore, that when the drain pump 54 is energized during the wash cycle, the accumulator 50 and the soil separation channel 46 are purged very quickly which reduces the pressure within the accumulator 50 and the soil separation channel 46 such that the backwash nozzles 51 can clean the filter screen 48. As a result, the accumulator 50, the soil separation channel 46 and filter screen 48 are cleared very quickly such that very little water—as little as 0.1 liters per purge—need be sent to drain to achieve an effective purge period.

Fluid flow through the soil separator and pump assembly 20 when the control valve 60 is allowed to open and the drain pump 54 is energized is shown in FIGS. 4 and 5*b*. Flow lines 66 illustrate the path of wash liquid drained from the sump through drain port 62. At the same time, wash liquid is drained from the accumulator 50 through drain conduit 55.

The control valve system 60 can be used to separate the sump 18 from the accumulator 50 during the initial portion of a drain cycle to avoid soil redeposition onto the dishes. This can be accomplished by continuing to operate the wash pump 28 during the early portion of the drain cycle to keep the control valve 60 in a closed position such that wash liquid is initially drained only through the accumulator 50 wherein the accumulator 50 is cleared of soils and rinsed by water entering from the sump. After some period of time or when the wash pump 28 begins to starve, the motor 34 may be deenergized such that the control valve 60 opens.

It can be understood by one skilled in the art that the operation of control valve system 60 allows for a thorough pump-out of wash liquid during drain such that little wash liquid remains in the sump 18 at the completion of a drain cycle. It would be possible, however, to provide an alternative embodiment of the present invention by omitting the control valve system 60. In such an embodiment, all wash liquid would be drained from the dishwasher through the soil accumulator 50.

Figure 7:
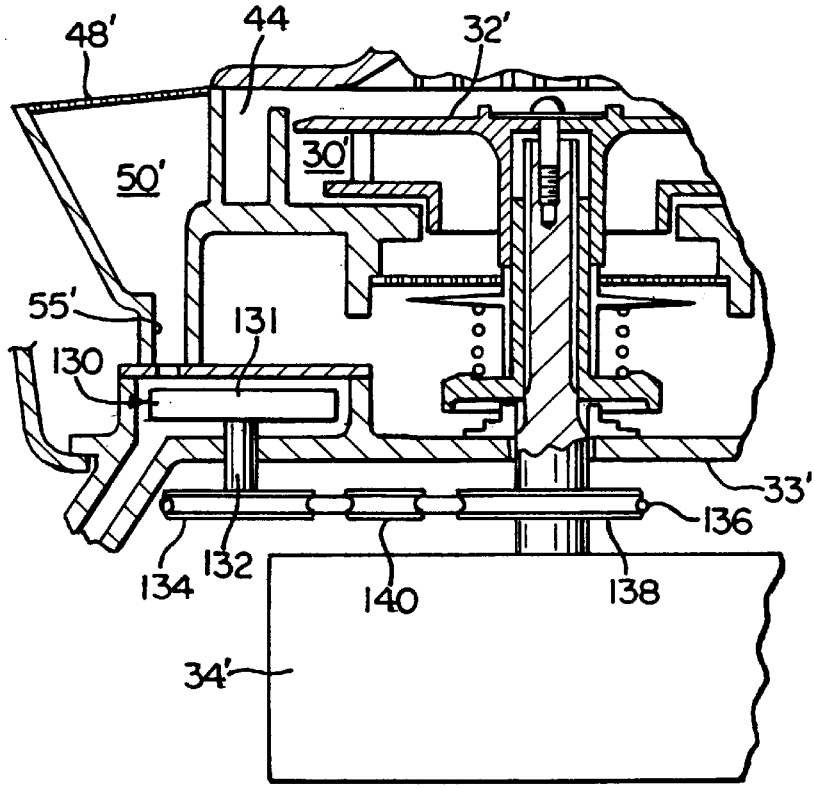
FIG. 7 is a partial sectional view of the pump and soil collector system illustrating an alternative drain pump embodiment for the present invention.

In FIG. 2, described above, the drain pump 54 is shown as a separate element apart from the main soil separator and pump assembly 20. As illustrated, the drain pump 54 would have a separate motor and could be energized independently of the wash pump motor 34. FIG. 7 illustrates an alternative embodiment to this type of separate drain pump system wherein the drain pump can be selectively energized separate from the main wash pump system while still being driven by the wash pump motor 34.

In FIG. 7, the drain pump 130 comprises a drain impeller 131 which is supported within a drain pump enclosure formed into the pump base 33'. The drain impeller 131 is driven by a shaft 132 which has a portion extending below the pump base 33' to which a pulley 134 is secured. The pulley 134 is driven by belt 136 extending about a drive pulley 138 associated with the drive shaft of the main motor 34' and an idler pulley 140. To energize the drain pump 130, the idler pulley 140 is moved by an actuator such as a solenoid or wax motor (not shown) such that the belt 136 is tightened allowing it to transfer torque to the pulley 134 from the drive pulley 138 for rotating the drain impeller 131. In this manner, the drain pump 130 may be energized for purging the accumulator or draining the dishwasher, as described above, by energizing the actuator associated with the idler pulley 140.

The present invention may be beneficially employed in a dishwasher having either an electromechanical control scheme utilizing a conventional timer or an electronic control scheme utilizing a microprocessor.

Figure 8:
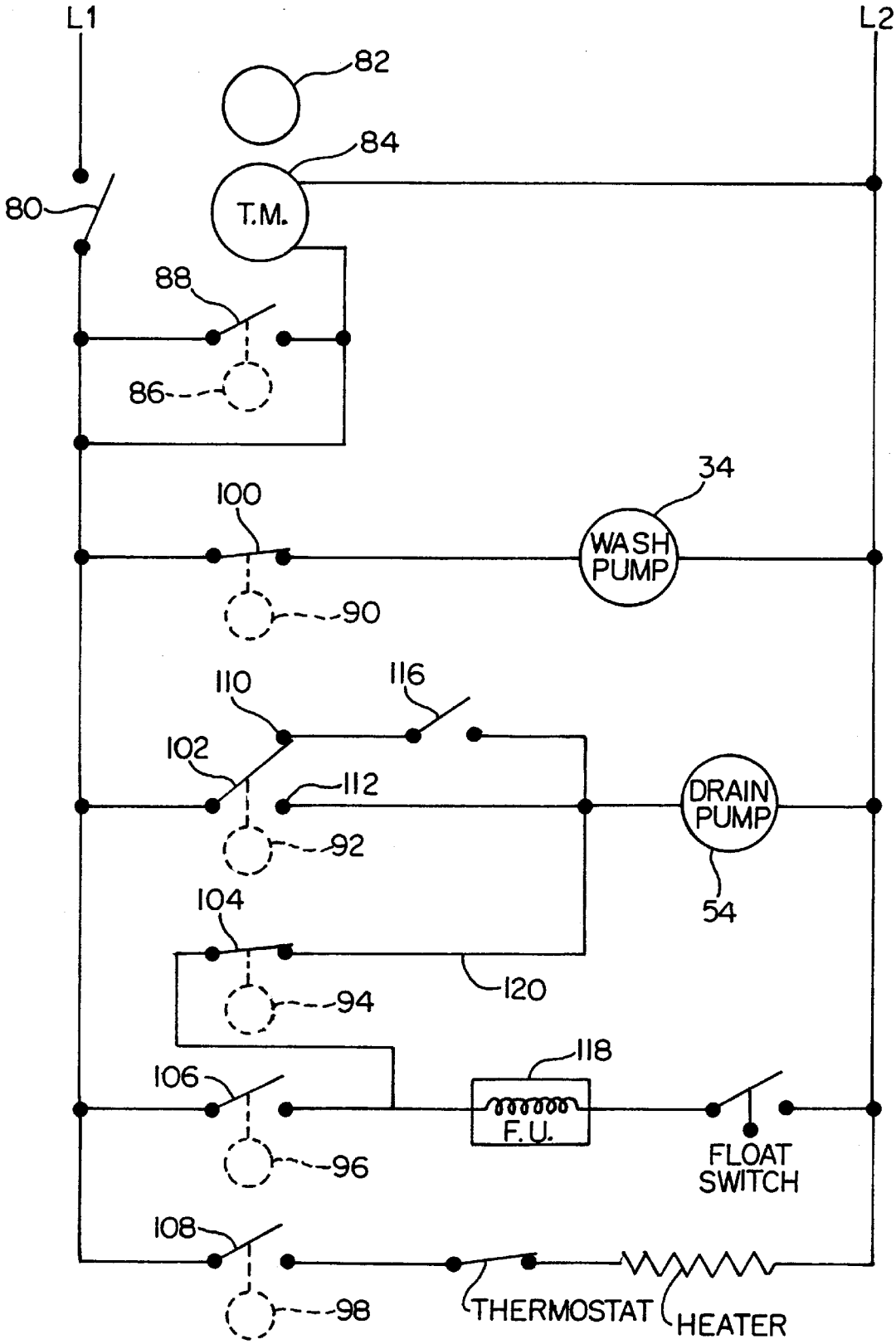
FIG. 8 is a schematic representation of electrical circuitry for an electromechanical embodiment of the dishwasher shown in FIG. 1.

Components of an electromechanical embodiment of the present invention are shown in FIG. 8. Current to the dishwasher is provided through lines L1 and L2. An interlock door switch 80 ensures that the dishwasher is deenergized when the door is opened. The dishwasher is started in its operating cycle by manipulation of a control knob 82. The control knob 82 is rotated a few degrees to turn the shaft of a timer motor 84 whereby cam 86 causes switch 88 to close, thereby energizing the timer motor 84. The advancing timer motor 82 rotates cams 90, 92, 94, 96 and 98 for selectively controlling switches 100, 102, 104, 106 and 108, respectively.

When switch 102 is positioned to complete the circuit through contact 110, the drain pump 54 is energized whenever pressure switch 116, operatively associated to pressure dome 53, closes in response to pressure in the accumulator 50 exceeding the predetermined limit pressure. Similarly, the drain pump 54 is deenergized when the pressure in the accumulator 50 falls below the predetermined limit pressure and the switch 116 opens. It can be understood that the drain pump 54 cycles on and off independently of the timer motor 84 rotation such that very short purge intervals are possible. Moreover, the drain pump 54 is energized independently of the wash pump motor 34.

The wash liquid sent to drain during each purge period may be replaced by having cam 94 close switch 104 such that fill valve 118 is energized simultaneously with the drain pump 54. During the machine fill portion of the dishwasher cycle, switch 104 is open and the fill valve 118 is energized through switch 106.

Alternatively, the wash liquid sent to drain during each purge period may also be accounted for by simply supplying a small amount of additional water into the dishwasher during the initial fill cycle wherein switch 104 and line 120 may be omitted from the dishwasher circuit. This "overfill" approach is a realistic alternative, given that only a small amount of wash liquid—as little as 0.1 liter—is sent to drain during each purge period.

Figure 9:
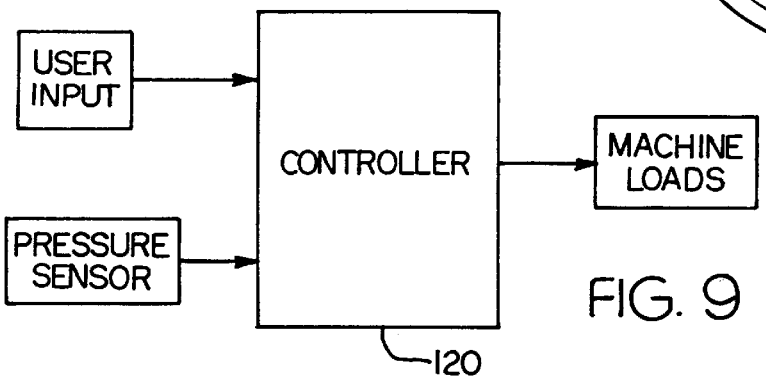
FIG. 9 is a schematic representation of the control elements for an electronic embodiment of the dishwasher shown in FIG. 1.
Figure 10:
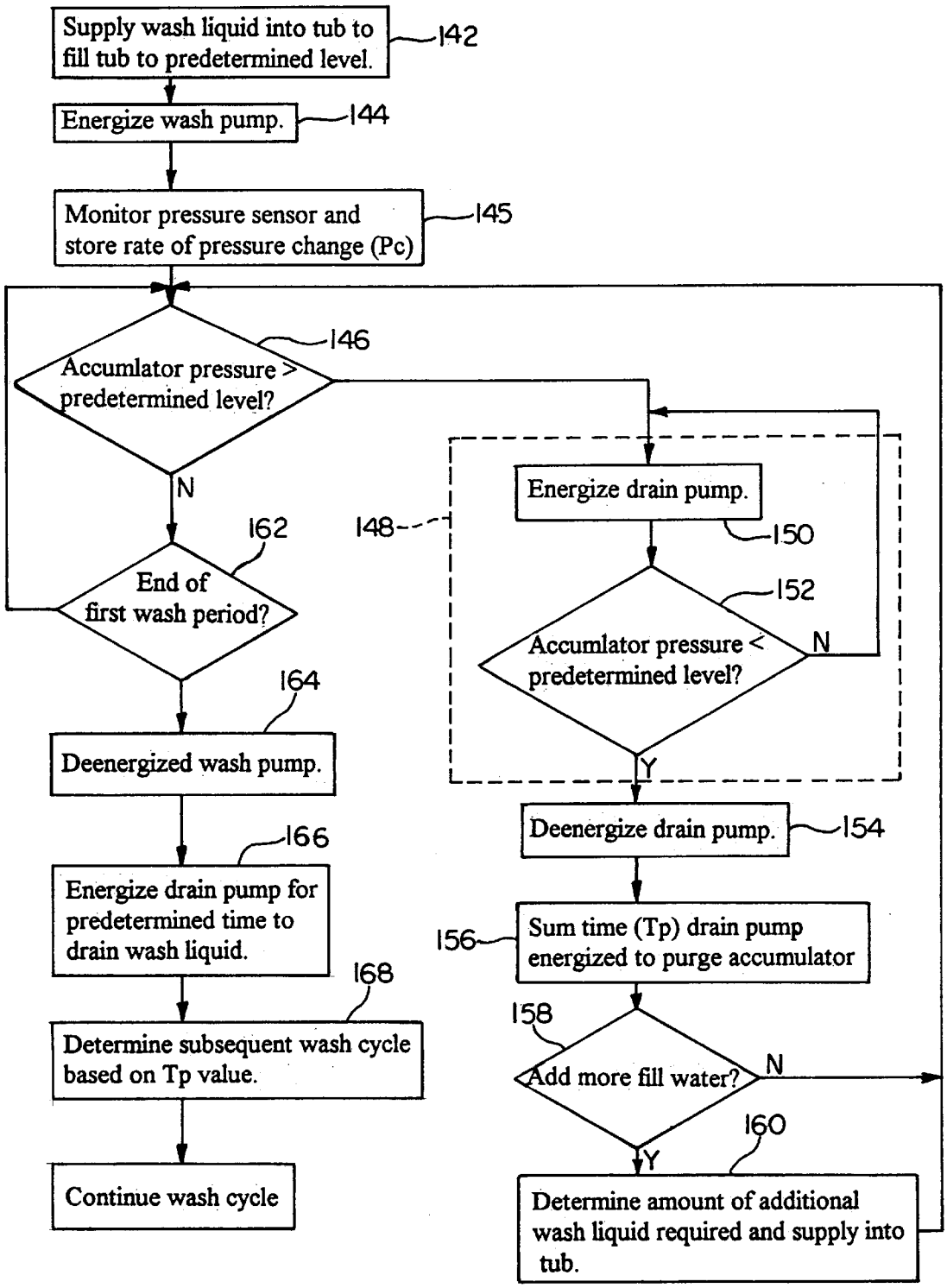
FIG. 10 is a flow chart illustrating the operation of an alternate embodiment of the dishwasher shown in FIG. 1 having a microprocessor control means.

FIG. 9 illustrates an electronic control embodiment of the present invention utilizing a microprocessor controller 120 which employs the control logic shown in FIG. 10.

Turning now FIG. 10, in steps 142 and 144, wash liquid is supplied into the dishwasher tub to a predetermined level whereupon the wash pump 34 is energized. In step 145, the controller 120 monitors the pressure within the accumulator 50 via input from the pressure sensor 52 and stores the rate of pressure change (Pc). If the pressure exceeds a predetermined limit, as shown in step 146, a purge routine 148 comprising steps 150 and 152 is initiated. After the accumulator 50 has been purged and the filter screen 48 is cleared, the drain pump 54 is deenergized in step 154. The drain pump may be deenergized when the accumulator pressure falls below the predetermined limit pressure. Alternatively, the drain pump may remain energized some predetermined time after the accumulator falls below the predetermined limit pressure or until the accumulator pressure reaches some predetermined reset pressure, lower than the predetermined limit pressure.

In steps 156, 158 and 160 the controller 120 counts the number of times (Np) the purge routine is initiated and sums the time (Tp) the drain pump was energized during the preceding purge periods. Based on that information, the controller 120 determines whether additional wash liquid is required to replace the quantity of water sent to drain during the prior purge routines. The purge routine 148 is initiated as frequently as required in response to pressure sensor 52 and is performed while the wash pump continues to recirculate wash liquid within the dishwasher. At the end of the initial wash period, the wash pump is deenergized and the wash liquid is drained from the dishwasher, as shown in steps 162, 164 and 166.

Following the initial wash period, the dishwasher cycle can be modified, as shown in step 168, in response to gathered information—Pc, Tp or Np—indicative of the quantity and type of soil. For example, the duration of the wash cycle length may be increased when heavy soil load is sensed as determined by the number of purge routines or additional fills may be added to the cycle. In this manner, the dishwasher is responsive to the soil load for selecting the optimum wash cycle.

The present invention may be readily employed in a fully automatic manner to provide a uniquely simple dishwasher cycle of operation. Specifically, the present invention makes it possible to effectively wash dishes with a two fill cycle as compared to present systems which typically require at least 5 fill cycles. In the two fill wash cycle, during the first fill cycle the dishwasher is operated to wash the dishes wherein the pump system is repeatedly purged until soil quantities in the wash liquid are reduced to a very low level. The second fill cycle can then be used as the single rinse cycle. Additionally, if initial soil levels are so low that there is no resulting accumulator pressure, as may occur with prerinsed dishes, the two fill cycle will be used as the normal cycle.

It can be seen, therefore, that the present invention provides for a substantial improvement in the efficiency of dishwasher operation. The present invention provides a unique pump system which washes dishes in a manner superior to the dishwashers presently available for sale while using substantially less energy and water than presently available dishwasher systems. Specifically, the inventors calculate that the present invention, if employed on all dishwashers in the United States (U.S.), would save almost 24 billion gallons of water a year and almost 4 billion KWH's per year—based on an assumption of 18 million dishwashers in use in the U.S. operated 300 times a year (6 times a week for 50 weeks a year).

While the present invention has been described with reference to the above described embodiments, those of skill in the art will recognize that changes may be made thereto without departing from the scope of the invention as set forth in the appended claims

What is claimed is:

1. A washer for washing particles off of objects with liquid, said washer comprising:

a wash chamber adapted for holding objects to be washed;

a sump adapted to hold liquid from the wash chamber;

a recirculation pump operable to move liquid from the sump to the wash chamber;

a drain pump operable to move liquid from the sump to a drain; and a controller for controlling the operation of the recirculation pump and the drain pump, said controller being operable to turn the recirculation pump on during a wash phase, and while the recirculation pump is running, to turn the drain pump on and off in order to move particles from the sump to the drain, said controller being operable to turn the drain pump on at the end of the wash phase in order to initiate a drain phase wherein the drain pump drains the sump of liquid.

2. The washer according to claim 1, further comprising an annular filter disposed over the sump.

3. The washer according to claim 1, wherein the controller is operable to keep the recirculation pump running while the drain pump is draining the sump of liquid during the drain phase.

4. The washer according to claim 1, further wherein the sump has a first sump chamber for collecting soils, the drain pump being fluidly connected to the first sump chamber.

5. The washer according to claim 4, wherein the recirculation pump has a main outlet and a secondary outlet, the secondary outlet supplying liquid to the first sump chamber.

6. The washer according to claim 5, wherein the first sump chamber further comprises:

a soil collector having a soil separation channel, the separation channel having a wall including a screen portion.

7. The washer according to claim 5, wherein the first sump chamber further comprises:

a soil collector having a soil separation channel and an accumulator region, the separation channel having a wall including a screen portion wherein soil laden wash liquid supplied into the separation channel is filtered by passing through the screen portion leaving soils to collect in the accumulator region.

8. The washer according to claim 7 further comprising:

a pressure sensor sensing the pressure within the soil collector wherein the drain pump is energized in response to the pressure within the soil collector.

9. A method for operating a dishwasher for removing soils off of dishes, the dishwasher comprising a wash chamber, a recirculation pump and a drain pump, the wash chamber having a lower portion defining a sump for receiving wash liquid, the recirculation pump being operable to distribute wash liquid from the sump through the wash chamber, the drain pump being operable to deliver wash liquid to drain, the method comprising the steps of:

introducing a quantity of wash liquid into the wash chamber;

recirculating wash liquid throughout the wash chamber for removing soils from dishes enclosed within the wash chamber during a wash phase;

energizing and de-energizing the drain pump during the wash phase while the recirculation pump is energized; and after the wash phase, energizing the drain pump during a drain phase wherein the drain pump drains the sump of liquid.

10. The method for operating a dishwasher according to claim 9, wherein the sump includes a first chamber for collecting soils and the drain pump is energized and de-energized to move soils from the first chamber to drain during the wash phase.

11. The method of operating a dishwasher according to claim 9, further wherein the sump includes a first chamber having a filter screen, the method further comprising the steps of:

pumping liquid into the first chamber during the wash phase; and filtering soils from the liquid as the liquid passes through the filter screen.

12. The method for operating a dishwasher according to claim 11, further comprising the steps of:

energizing the drain pump during the wash phase in response to the pressure within the first chamber.

13. The method for operating a dishwasher according to claim 9, wherein the recirculation pump has a main outlet and a secondary outlet, the sump includes a soil collector for collecting soils, the method further comprising the steps of:

supplying wash liquid through the secondary outlet to the soil collector;

collecting soils within the soil collector; and energizing and de-energizing the drain pump for moving soils from the soil collector to drain during the wash phase while the recirculation pump is energized.

14. A washer for washing particles off of objects with liquid, said washer comprising:

a wash chamber adapted for holding objects to be washed;

a sump adapted to hold liquid from the wash chamber;

a recirculation pump operable to move liquid from the sump to the wash chamber;

a drain pump operable to move liquid from the sump to a drain; and a controller for controlling the operation of the recirculation pump and the drain pump, said controller being operable to turn the recirculation pump on during a wash phase, and while the recirculation pump is running, to turn the drain pump on and off in order to move particles to the drain, said controller being operable to turn the drain pump on at the end of the wash phase in order to initiate a drain phase wherein the drain pump drains the sump of liquid.

15. The washer according to claim 14, further comprising an annular filter disposed over the sump.

16. The washer according to claim 14, wherein the controller is operable to keep the recirculation pump running while the drain pump is draining the sump of liquid during the drain phase.

17. The washer according to claim 14, further wherein the sump has a first sump chamber for collecting particles, the drain pump being fluidly connected to the first sump chamber for moving particles from the sump to drain.

18. The washer according to claim 14, wherein the recirculation pump has a main outlet and a secondary outlet, the secondary outlet supplying liquid to the first sump chamber.

19. The washer according to claim 18, wherein the first sump chamber further comprises:

a soil collector having a soil separation channel, the separation channel having a wall including a screen portion.

20. The washer according to claim 18, wherein the first sump chamber further comprises:

a soil collector having a soil separation channel and an accumulator region, the separation channel having a wall including a screen portion wherein wash liquid supplied into the separation channel is filtered by passing through the screen portion leaving particles to collect in the accumulator region and wherein the drain pump is fluidly connected to the soil collector for moving particles from the soil collector to drain.

21. The washer according to claim 20 further comprising:

a pressure sensor sensing the pressure within the soil collector wherein the drain pump is energized in response to the pressure within the soil collector.

* * * * *